US008511213B2

(12) United States Patent
Harvey

(10) Patent No.: US 8,511,213 B2
(45) Date of Patent: Aug. 20, 2013

(54) HAND-HELD TOOL FOR REMOVING PRIMERS FROM SPENT FIREARM CARTRIDGES

(76) Inventor: Roger Lee Harvey, Lebanon, OR (US)

( * ) Notice: Subject to any disclaimer, the term of this patent is extended or adjusted under 35 U.S.C. 154(b) by 16 days.

(21) Appl. No.: 13/278,618

(22) Filed: Oct. 21, 2011

(65) Prior Publication Data

US 2013/0098230 A1 Apr. 25, 2013

(51) Int. Cl.
*F42B 33/04* (2006.01)

(52) U.S. Cl.
USPC ..... 86/24; 86/37

(58) Field of Classification Search
USPC ..... 42/90, 108, 106; 102/430, 464, 102/204, 293; 86/10, 19.5, 19.6, 19.7, 19.8, 86/32, 33, 36, 37, 24
See application file for complete search history.

(56) References Cited

U.S. PATENT DOCUMENTS

| | | | | | |
|---|---|---|---|---|---|
| 139,674 | A * | 6/1873 | Holmes | 86/37 |
| 257,860 | A * | 5/1882 | Gill | 86/37 |
| 272,215 | A * | 2/1883 | Darling | 86/24 |
| 294,865 | A * | 3/1884 | Giffard | 86/30 |
| 329,135 | A * | 10/1885 | Brown | 86/24 |
| 358,769 | A * | 3/1887 | Boyd et al. | 86/24 |
| 378,400 | A * | 2/1888 | Lyon | 86/24 |
| 387,868 | A * | 8/1888 | Farrow | 86/37 |
| 514,737 | A * | 2/1894 | Smith | 86/24 |
| 536,045 | A * | 3/1895 | Ripley | 86/37 |
| 739,151 | A * | 9/1903 | Chick | 86/37 |
| 746,368 | A * | 12/1903 | Olney | 86/37 |
| 2,314,115 | A * | 3/1943 | Albree | 86/37 |
| 3,180,204 | A * | 4/1965 | Sampson | 86/37 |
| 3,735,666 | A * | 5/1973 | Decker | 86/24 |
| 4,176,583 | A * | 12/1979 | Lage | 86/24 |
| 4,566,366 | A * | 1/1986 | Lee | 86/24 |
| 5,698,809 | A * | 12/1997 | Holt | 86/24 |

* cited by examiner

*Primary Examiner* — Michael Carone
*Assistant Examiner* — John D Cooper
(74) *Attorney, Agent, or Firm* — Roger L Harvey

(57) ABSTRACT

A hand-held portable tool to remove primers from spent firearm cartridges, comprising a depriming rod, a lever, and a handle. Compression of the lever with hand pressure while a cartridge is mounted on the depriming rod and is trapped inside the handle pushes the primer out of the cartridge without the use or need of any type of springs, dies or shell holders for various calibers.

5 Claims, 7 Drawing Sheets

HAND-HELD TOOL FOR REMOVING PRIMERS FROM SPENT FIREARM CARTRIDGES

CROSS-REFERENCE TO RELATED APPLICATION

This application claims priority of U.S. Provisional Application Ser. No. 61/497,069, filed Jun. 15, 2011, incorporated herein by reference in its entirety.

BACKGROUND OF THE INVENTION

The present invention relates to the art or reloading ammunition, particularly the removal of primers from empty cartridge cases. In this specification and the appended claims, the term "cartridge" generally denotes an empty cartridge case.

Current products use either a large bench-mounted press or a hammer and pin to punch primers out. A hand-held depriming tool is portable, frees up bench space and allows complete cleaning of the cartridge, including the primer pocket when the primer is removed first. A hand-held depriming tool allows removal of primers immediately after firing if desired.

SUMMARY OF THE INVENTION

The present invention comprises a new hand tool for removing primers, the tool requiring only one hand to operate. The hand tool is small, compact and easily carried, making it a tool convenient to use at any time or location.

Another feature of the present invention is that the lever, being activated by hand pressure, allows for greater sensitivity and control compared with current bench-mounted deprimers.

A further feature of the current invention is the simplicity achieved by not using springs. Using only two moving parts provides dependability and durability.

A still further feature is that the tool works without any additional parts such as shell holders or dies that otherwise would be needed for different pistol and rifle cartridges.

DETAILED DESCRIPTION

Figure 8:
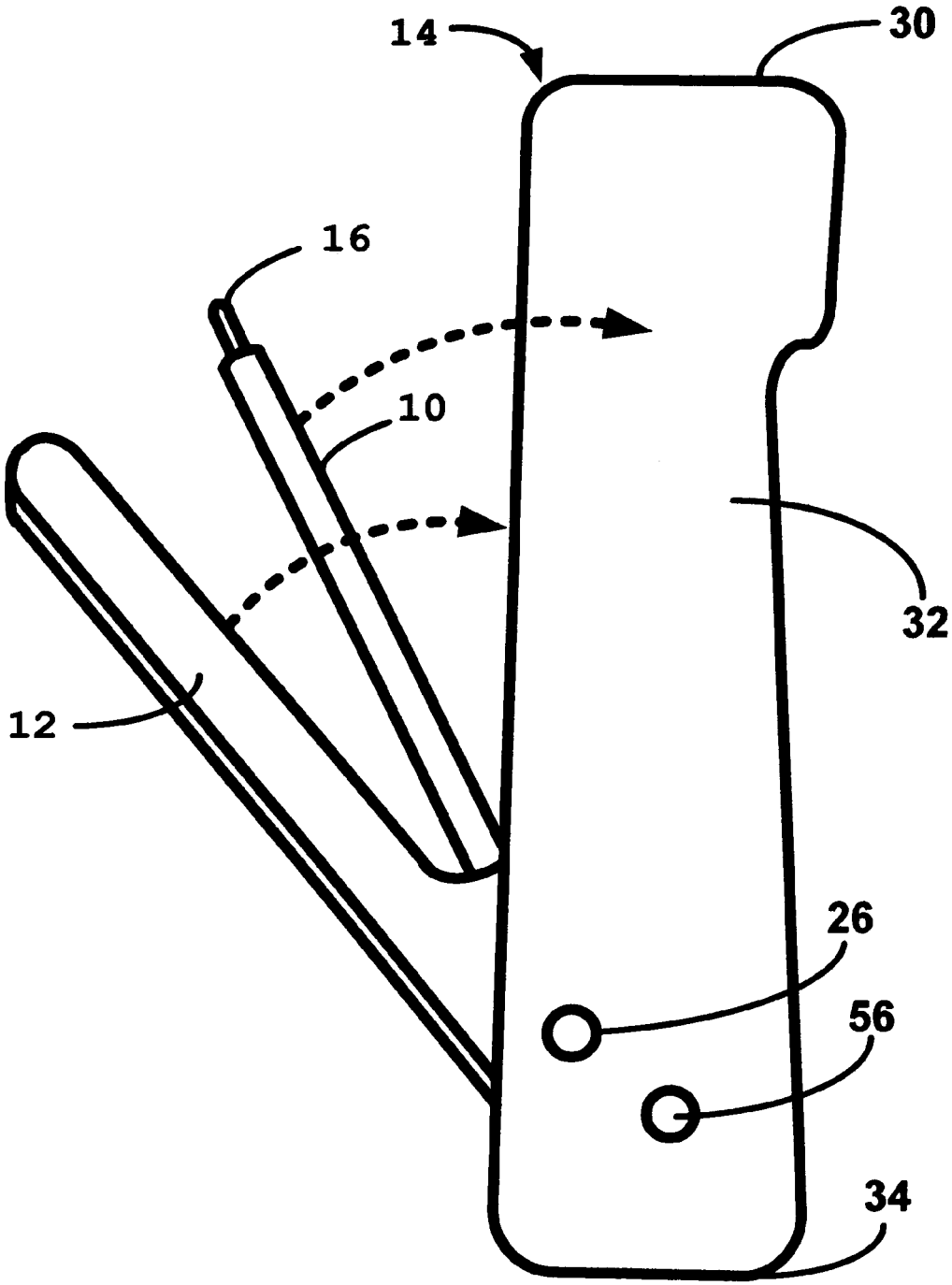
FIG. 8 is a an assembly view of the lever and depriming rod inserted and connected to the handle in an open position.

A primer removal tool FIG. 8 comprises a handle, a depriming rod, and a lever:

A handle, side view shown in FIGS. 3-6, resembling an elongated tube, comprises two parallel sides, joined to a third piece along their long side to create a third, or back side. The fourth side or front is open, thereby forming an elongated recess to receive the depriming rod.

Figure 1:
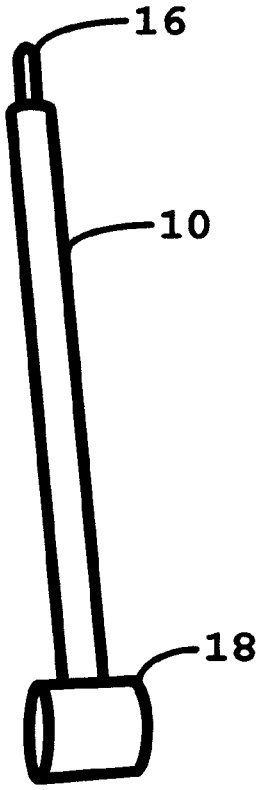
FIG. 1 is a perspective view of the depriming rod.
Figure 2:
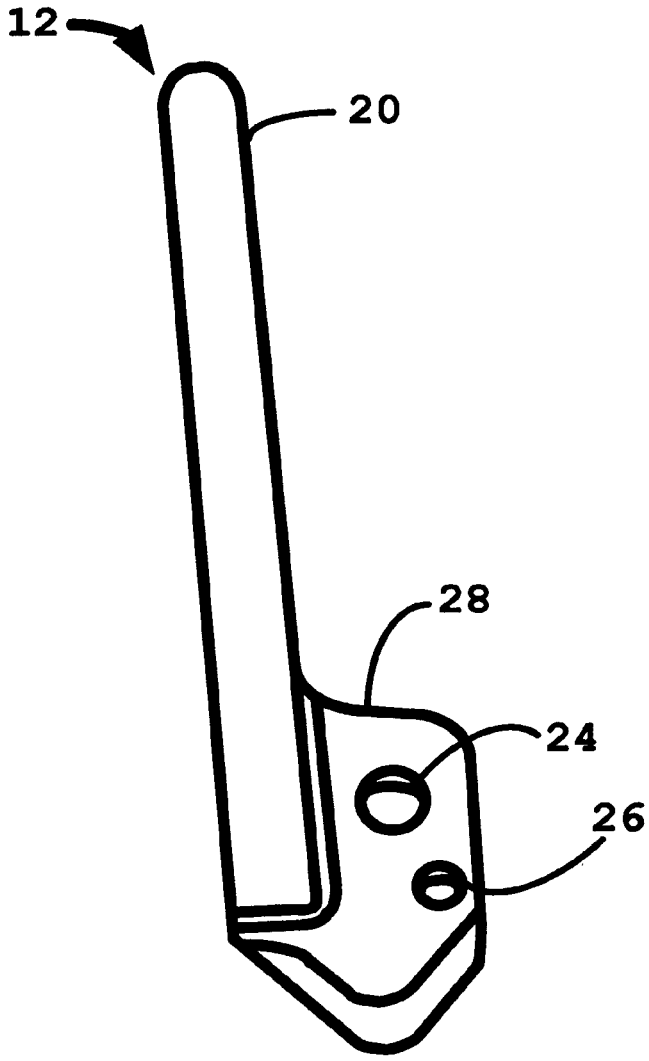
FIG. 2 is a side view of the hand-actuated lever.

A depriming rod FIG. 1 has a narrow point or depriming pin 16 on one end, and a cylindrical bearing 18 attached to the opposite end 48 that serves as a pivot point where the depriming rod 10 is attached to the actuating lever 12 (as shown in FIG. 2).

An actuating lever, FIG. 2, is pivotably secured to the lower end of the handle by means of a transverse pin 56 allowing the lever 12 to rotate (FIG. 8). Also formed on the lower portion of the lever 12 and forming a bearing for the pivot pin, is an integral collar 28 having an upwardly facing appendage that rotates into the handle 14. The upper portion of the lever 12 is in the form of a lever handle 20 and the lever 12 is pivotable from the upright position illustrated in FIG. 8. When a portion of the actuating lever is positioned flush against the handle body as in FIG. 11 the depriming rod 10 is extended upwards to its maximum elevation, extending past the trapping face 50 into the slot 48, shown in FIG. 6. A transverse pin 56 integrally extends across the handle body 14 upon which the actuating lever 12 pivots.

The bottom inside edge of the elongated recess of the handle 14 is flared 34 to allow room for primers to fall free of the handle 14.

Figures 10, 11, 12:
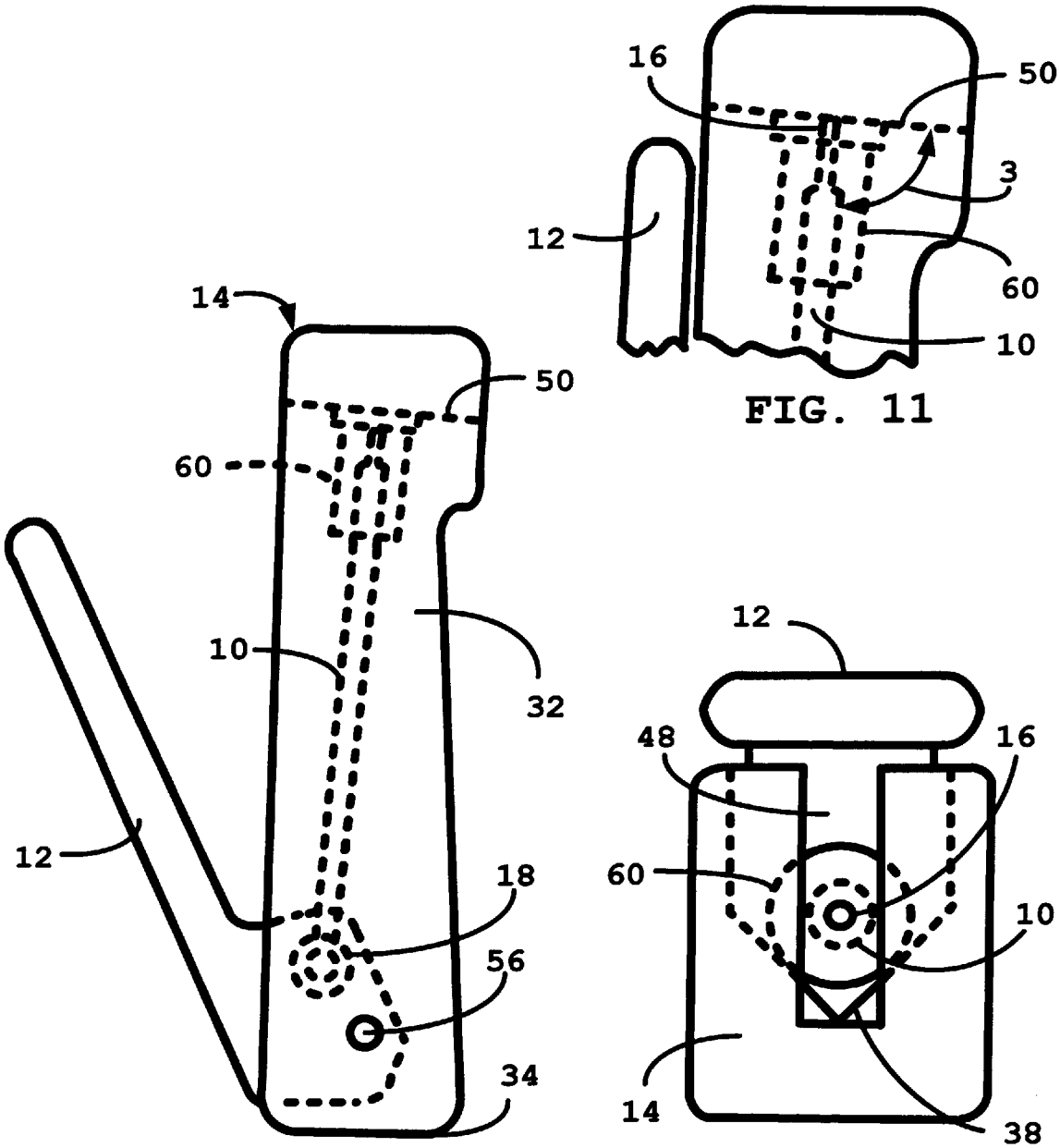
FIG. 10 is an assembly view, showing a cartridge and depriming rod positioned inside the handle.
FIG. 11 is a partially broken-away view showing the correct angle between the depriming rod and trapping face.
FIG. 12 is a top view of the handle shown with the lever shut, i.e., fully actuated, and the cartridge deprimed.

The top 30 of the handle 14 has a thick slotted head 52 that allows the cartridge to be trapped against the face (trapping face) of the slot 50 and allowing the primer to be ejected through the slot 48. The trapping face 50 receives and traps the base of a cartridge shell flush across the surface allowing maximum contact between cartridge base and the trapping face. This is achieved by a 90-degree angle 3 between depriming rod shaft 10 and the trapping face 50, as shown in FIG. 11.

Figure 4:
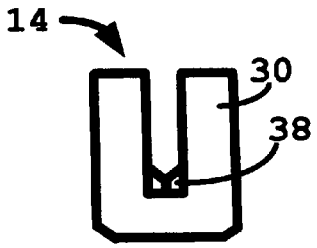
FIG. 4 is a top view of the handle.
Figure 5:
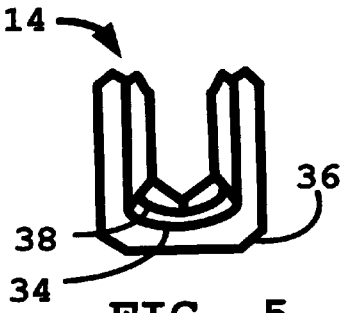
FIG. 5 is a bottom view of the handle.
Figure 6:
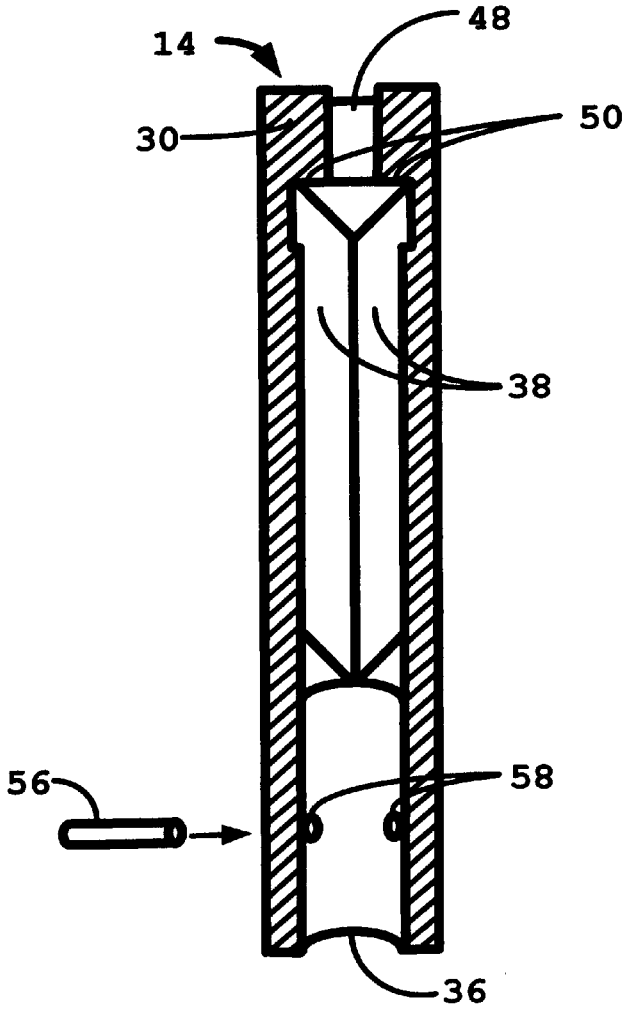
FIG. 6 is a front cross-sectional view of the handle, looking inside.

As shown in FIGS. 4-6, the top inside edge of the handle 14 is grooved in a "V" groove 38. The "V" groove 38 axially aligns the cartridge with the slot 48 to eject primers.

Figure 3:
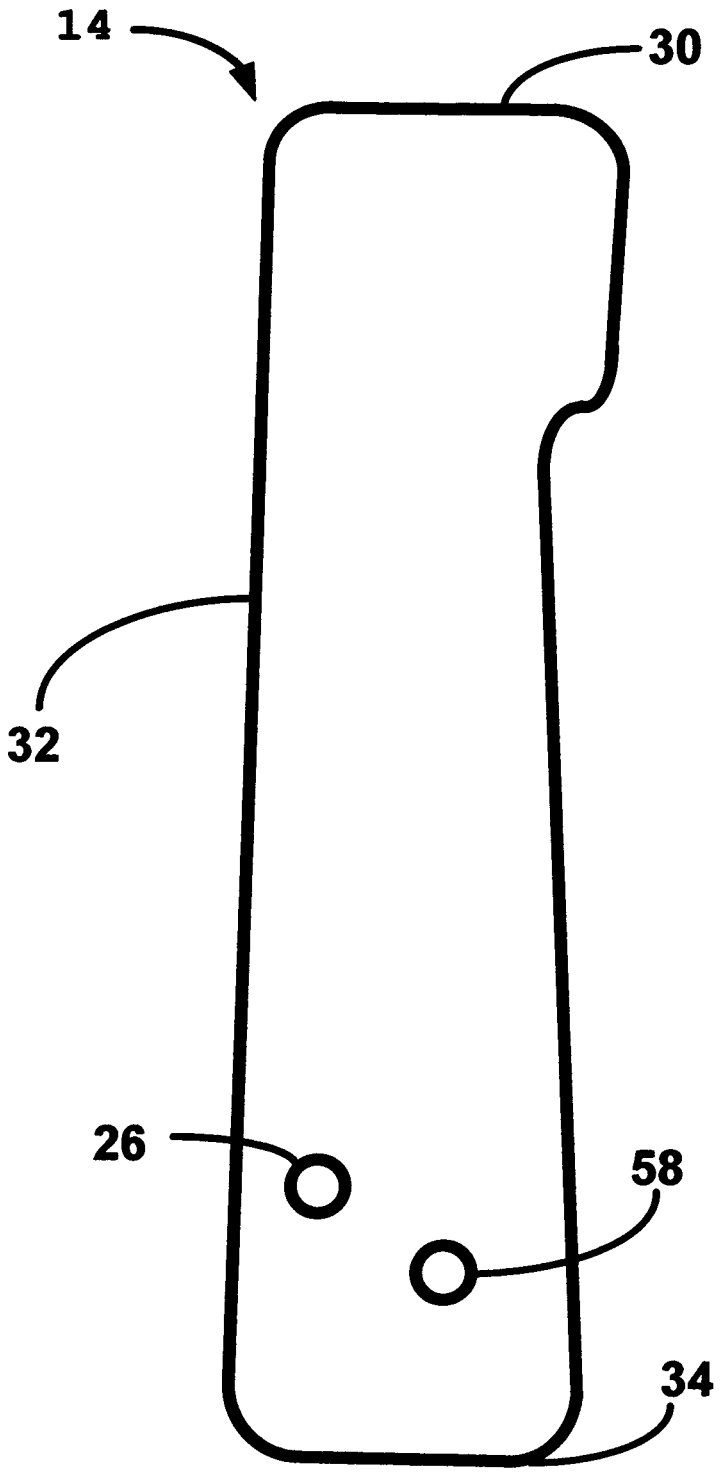
FIG. 3 is a side view of the handle.

As shown in FIG. 3, the back side of the handle 14 is contoured for an ergonomic grip 32 and the base has a transverse pin 26 extending from one side (parallel to the other side) for the actuating lever 12 to pivot about.

As shown in FIG. 5, the inside bottom 34 of the handle 14 is flared to assist the free fall of dislodged primers.

Figure 7:
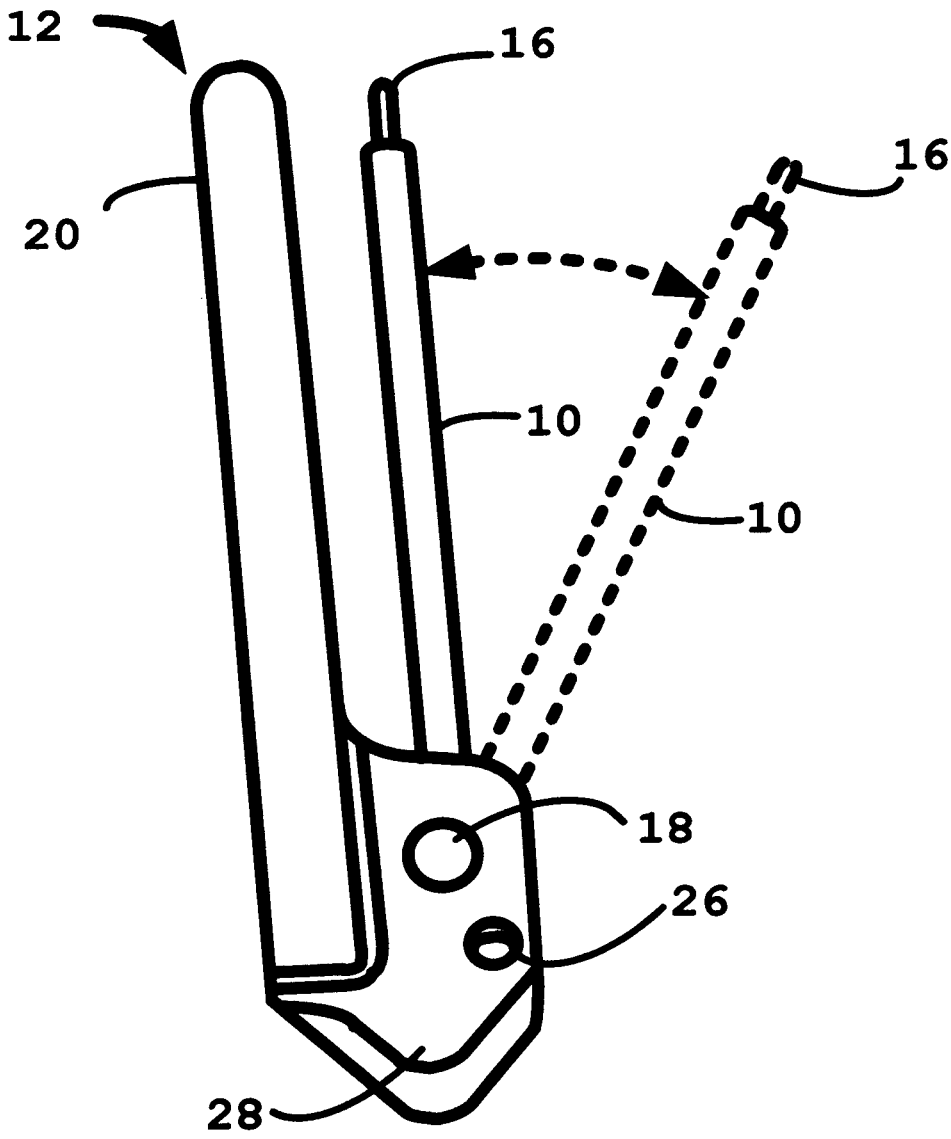
FIG. 7 is a view of the hand lever with deprimng rod attached, showing the range of motion through which the depriming rod pivots.

As shown in FIG. 7, actuating lever 12 has its lower end pivotally joined 26 to the handle 14, the lever 12 being pivotable from a position wherein the upper end is angled outwardly away from the handle (e.g., as in FIG. 8.)

Lever 12 is adapted to raise depriming rod 10 in response to pivotal movement of lever 12 to an upright position parallel to handle 14 to force a primer out of the cartridge trapped in the handle as in FIG. 11.

Figure 9:
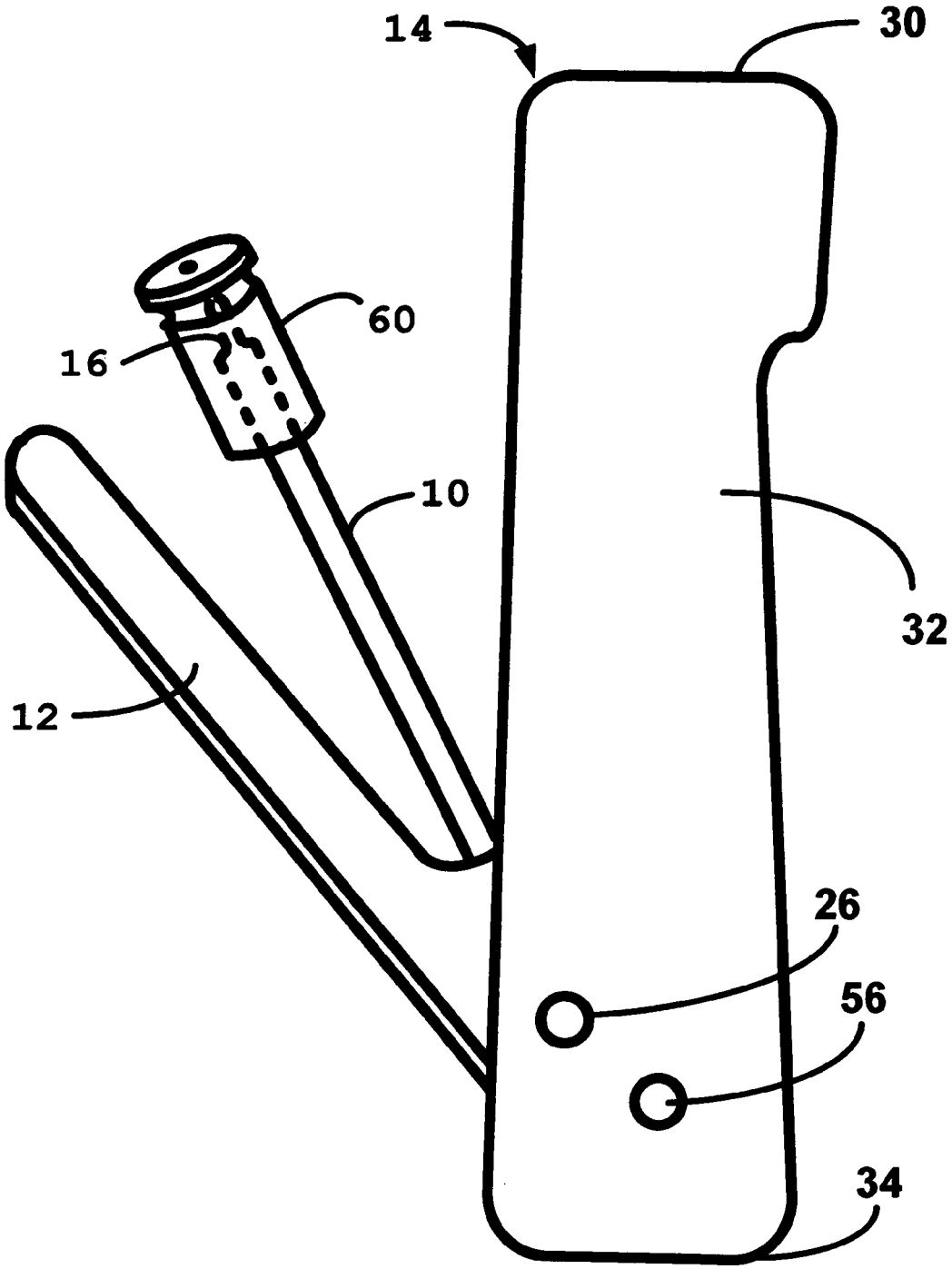
FIG. 9 is an assembly view with a cartridge positioned for primer removal.

With the tool in an open position as in FIG. 9, a cartridge 60 is placed on depriming rod 10 thus being automatically centered on the rod 10 when the depriming pin 16 is inserted in the primer hole of cartridge 60.

FIG. 12 shows the depriming rod 10 swung inside the handle 14, making the cartridge contact the "V" groove 38 slot inside the recess in handle 14, thus automatically centering the cartridge 60 on the vertical axis of the handle, aligning the cartridge axially with the opening slot 48 between the two portions of the trapping face 50 on the handle head 52.

FIGS. 10-12 show that when the actuating lever 12 is swung toward the handle 14, the offset pivot point 26 forces the depriming rod 10 to ride upwardly within the handle body 14, trapping the cartridge 60 against the trapping face 50 of the slotted head 52 in the handle 14. The depriming pin 10 continues upward, protruding past the trapping face 50, and ejecting the primer out of the cartridge 60. through slot 48 (shown in FIG. 12).

Tactile feedback is generated by the manual feel and manipulation of the pivotable lever 12. Relaxing of the user's grip allows the lever 12 and depriming rod 10 to rotate back to the open position where another cartridge can be placed on the depriming pin 16. Thus, the manual manipulation of the lever permits a feeling when the primer is being ejected, allowing a desirable sensory feedback, which is not available from bench-mounted presses.

Since the depriming pin 16 is the mounting device for the cartridge 60, no other shell holders or dies are required and all cartridges that fit in the handle 14, with the depriming rod 10 and depriming pin 16 mounted in the primer hole, can be deprimed, making this hand-held deprimer a universal depriming tool.

The tool has no springs and only two moving parts, making the tool simple, reliable, rugged, and durable in construction.

From the foregoing detailed description it will be seen that the present invention provides a new depriming tool for use in reloading. The tool is small and compact so that it can be readily carried personally for reloading while on the shooting range or in the field.

It is to be understood that while a preferred embodiment of the present invention has been illustrated and described in detail, such description is intended to be illustrative rather than limiting. Numerous variations will undoubtedly occur to those skilled in the art. What is intended to be covered herein, therefore, is not only the illustrated form of the invention but also any and all modifications or variations thereof that may come within the spirit of the invention and within the scope of the following claims.

The invention claimed is:

1. A hand-operated tool for removing a primer from a pistol or rifle cartridge case, the tool comprising:

a) a handle having first and second ends, a longitudinal axis, and a slot at the first end of the handle, the slot being aligned with the longitudinal axis, and an elongated opening communicating with the slot and extending to the second end of the handle, the elongated opening having a rear wall having a V-groove, the V-groove being oriented parallel to the longitudinal axis of the handle;

b) a depriming rod disposed within and generally parallel to the elongated opening, the depriming rod having a tip adapted for pressing a primer from a cartridge case, the tip being disposed toward the slot of the handle, and a pivotable end opposite the tip, the pivotable end having a cylindrical bearing whereby the pivotable end of the depriming rod is pivotably connected to the handle; and c) a lever rotatably connected to the handle by a hinge pin disposed adjacent to the second end of the handle, the lever comprising:

an elongated portion extending generally toward the first end of the handle, and an integral appendage adapted to rotate into the opening of the handle when the lever is actuated, the appendage having a collar pivotably engaging the cylindrical bearing at the pivotable end of the depriming rod, and wherein the depriming rod and V-groove are adapted to center the cartridge, whereby the tool is adapted for various sizes of cartridges.

2. The tool of claim 1, wherein the V-groove of the rear wall of the elongated opening of the handle is flared to allow free fall of dislodged primers.

3. The tool of claim 1, wherein the slot at the first end of the handle terminates at a trapping face disposed perpendicularly to the longitudinal axis of the handle, whereby a cartridge may be trapped against the trapping face of the slot and the primer is ejected through the slot when the lever of the tool is actuated.

4. The tool of claim 1, wherein the handle and lever have edges and wherein the handle and lever are formed with rounded edges to provide an ergonomic grip.

5. A method for using the tool of claim 1, the method comprising steps of:

a) swinging the depriming rod with cartridge into the handle, and b) actuating the lever towards the handle, thereby pushing the depriming rod against the primer, whereby the primer is removed.

* * * * *